US005964959A

United States Patent [19]

Bleth

[11] Patent Number: 5,964,959

[45] Date of Patent: Oct. 12, 1999

[54] SHOE CLEANING DEVICE

[75] Inventor: Joel J. Bleth, Dickinson, N. Dak.

[73] Assignee: PSI-ETS, Dickinson, N. Dak.

[21] Appl. No.: 09/133,585

[22] Filed: Aug. 13, 1998

[51] Int. Cl.[6] ..... B08B 3/02

[52] U.S. Cl. ..... 134/32; 134/34; 134/104.2; 134/153; 134/182; 134/199

[58] Field of Search ..... 134/32, 34, 104.2, 134/151, 153, 182, 199; 15/36

[56] References Cited

U.S. PATENT DOCUMENTS

| | | |
|---|---|---|
| 919,111 | 4/1909 | Zenke . |
| 1,443,503 | 1/1923 | Ritter . |
| 1,467,814 | 9/1923 | Ritter . |
| 1,538,907 | 5/1925 | Ritter . |
| 1,546,236 | 7/1925 | Haywood . |
| 1,881,036 | 10/1932 | Uden . |
| 2,641,771 | 6/1953 | Schiro . |
| 2,809,406 | 10/1957 | Walter . |
| 2,958,883 | 11/1960 | Walters . |
| 3,064,296 | 11/1962 | Lidke . |
| 3,066,338 | 12/1962 | Nappi . |
| 3,641,609 | 2/1972 | Hansen . |
| 3,699,984 | 10/1972 | Davis . |
| 3,787,918 | 1/1974 | Ebert . |
| 3,902,513 | 9/1975 | Franz . |
| 3,973,286 | 8/1976 | Logan . |
| 4,024,599 | 5/1977 | Gamboa . |
| 4,233,707 | 11/1980 | Leblanc . |
| 4,509,545 | 4/1985 | Trotter . |
| 4,922,578 | 5/1990 | Miettinen . |
| 5,418,996 | 5/1995 | Chen . |

FOREIGN PATENT DOCUMENTS

| | | | |
|---|---|---|---|
| 8503246 | 8/1985 | WIPO | 134/32 |

*Primary Examiner*—Philip R. Coe
*Attorney, Agent, or Firm*—W. Scott Carson

[57] ABSTRACT

A shoe cleaning device using liquid sprays and including a housing with a base portion and two side portions. The side portions are spaced from each other and extend upwardly from the base portion to form a U-shaped opening through the housing. In the preferred embodiment, rollers support the user's shoe as it is moved through the housing. Crisscrossing, upwardly directed sprays then strike and clean the shoe bottom while downwardly directed side sprays clean the shoe sides. Any portions of the upwardly directed, crisscrossing sprays not striking the user's shoe are captured in the opposing side portions and directed into the base portion. In this manner, the bottoms and sides of the user's shoes can be effectively cleaned without getting the user's leg or the tops of the shoes wet.

36 Claims, 7 Drawing Sheets

Fig. 1
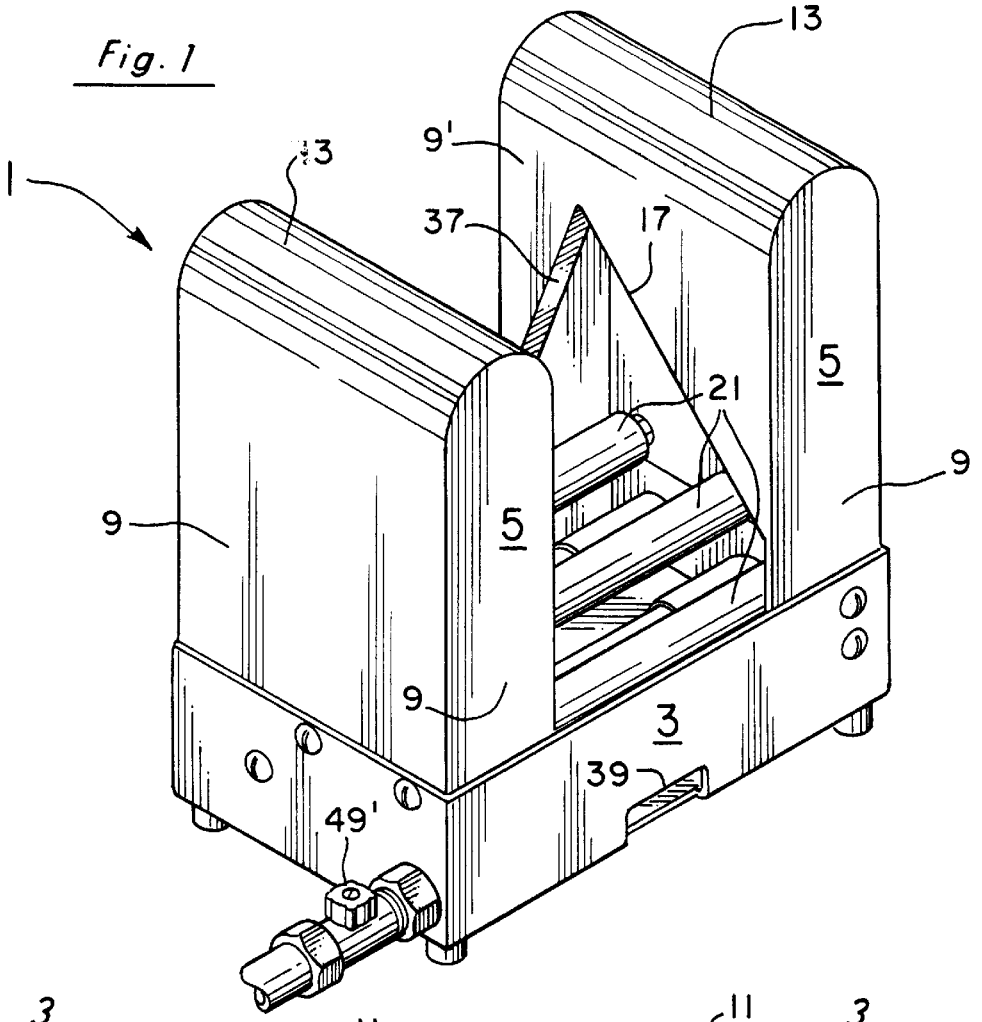
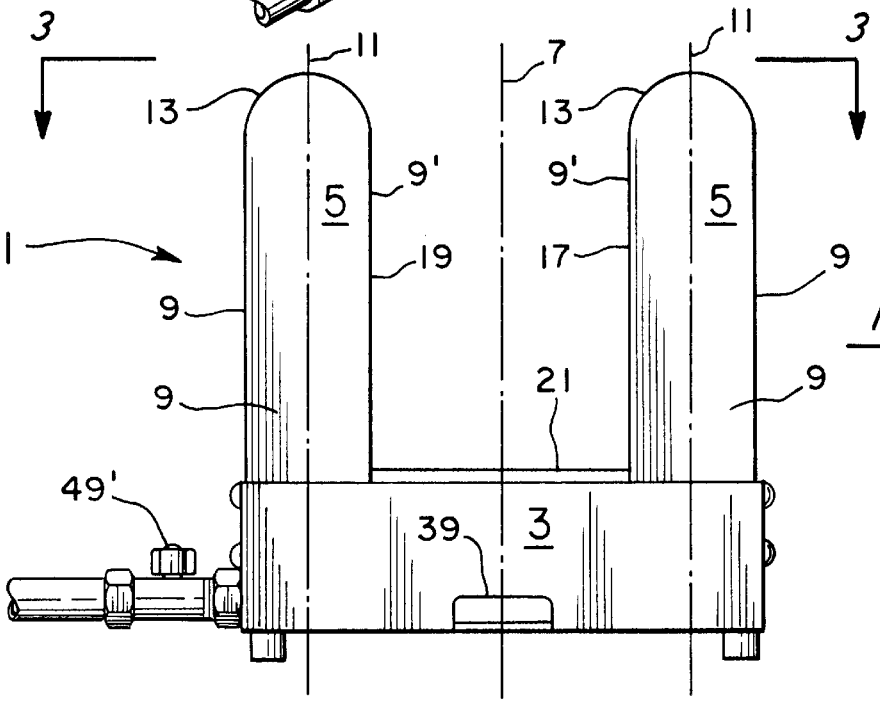
Fig. 2

SHOE CLEANING DEVICE

BACKGROUND OF THE INVENTION

1. Field of the Invention.

This invention relates to the field of shoe cleaning devices and more particularly to shoe cleaning devices that use liquid sprays.

2. Discussion of the Background.

Shoe cleaning devices using liquids such as water offer several design challenges. Fundamentally, the device must contain and control the water sprays so they strike and clean the desired portions (e.g., bottom and sides) of the shoe without unduly wetting the user's leg and other portions (e.g., top) of the shoe. Additionally, the device preferably would operate from readily available water sources (e.g., outside faucet of a home or recreational vehicle) at commonly available water pressures (e.g., 40 pounds per square inch). Further, it would do an effective cleaning job using as little water as possible. Low water usage and conservation are of particular importance with recreational vehicles which have limited water storage and commonly have pumps capable of delivering only 2–3 gallons a minute at 40 psi.

With these concerns and others in mind, the shoe cleaning device of the present invention was developed. With it, the user can easily and quickly clean dirt and other debris from the bottoms and sides of his or her shoes in an efficient and effective manner.

SUMMARY OF THE INVENTION

This invention involves a shoe cleaning device that uses liquid sprays. The device includes a housing with a base portion and two side portions. The side portions are spaced from each other and extend upwardly from the base portion to form a U-shaped opening through the housing. In the preferred embodiment, rollers support the user's shoe as it is moved through the housing. Crisscrossing, upwardly directed sprays then strike and clean the shoe bottom while downwardly directed side sprays clean the shoe sides. Any portions of the upwardly directed, crisscrossing sprays not striking the user's shoe are captured in the opposing side portions and directed into the base portion. In this manner, the bottoms and sides of the user's shoes can be effectively cleaned without getting the user's leg or the tops of the shoes wet.

BRIEF DESCRIPTION OF THE DRAWINGS

FIG. 1 is a perspective view of the shoe cleaning device of the present invention.

FIG. 2 is a front elevational view of the shoe cleaning device.

DETAILED DESCRIPTION OF THE PREFERRED EMBODIMENT

As best seen in FIGS. 1 and 2, the shoe cleaning device 1 of the present invention includes a housing with a base portion 3 and two side portions 5. The side portions 5 (see FIG. 2) extend upwardly from the base portion 3 on opposite sides of the central plane 7. The base portion 3 and side portions 5 together define or form a substantially U-shaped opening through the housing of the device 1. Preferably, the U-shaped opening has both open ends and an open top as shown in FIGS. 1 and 2.

Figure 3:
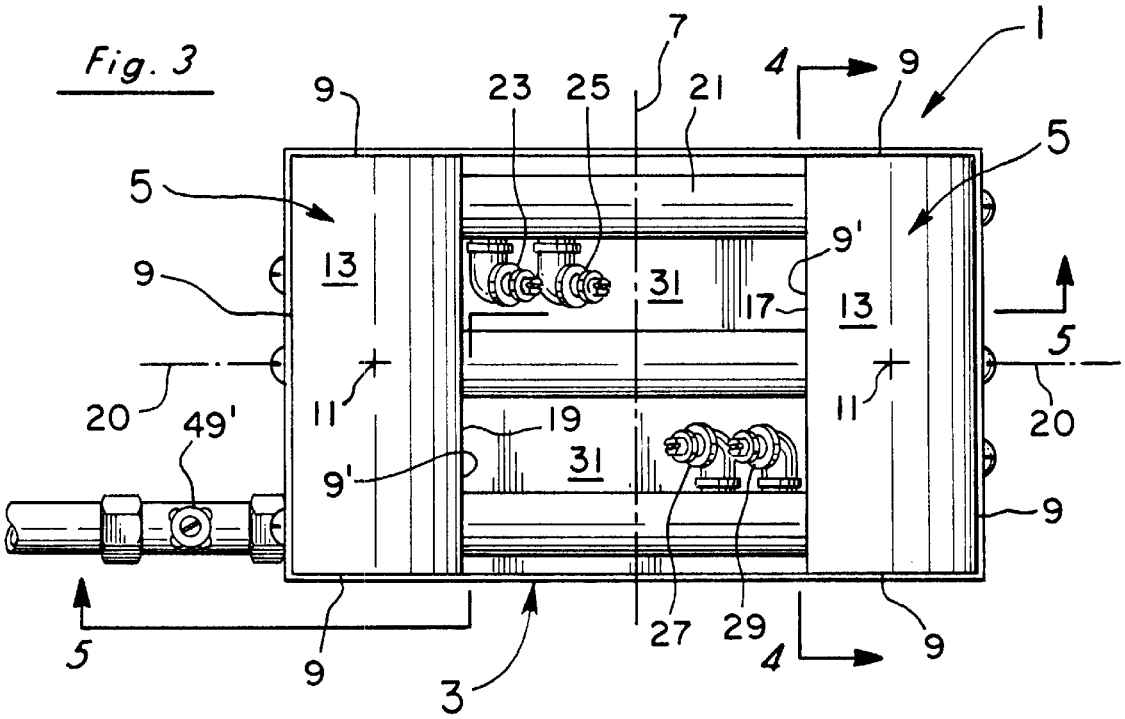
FIG. 3 is a top plan view taken along line 3—3 of FIG. 2.
Figure 4:
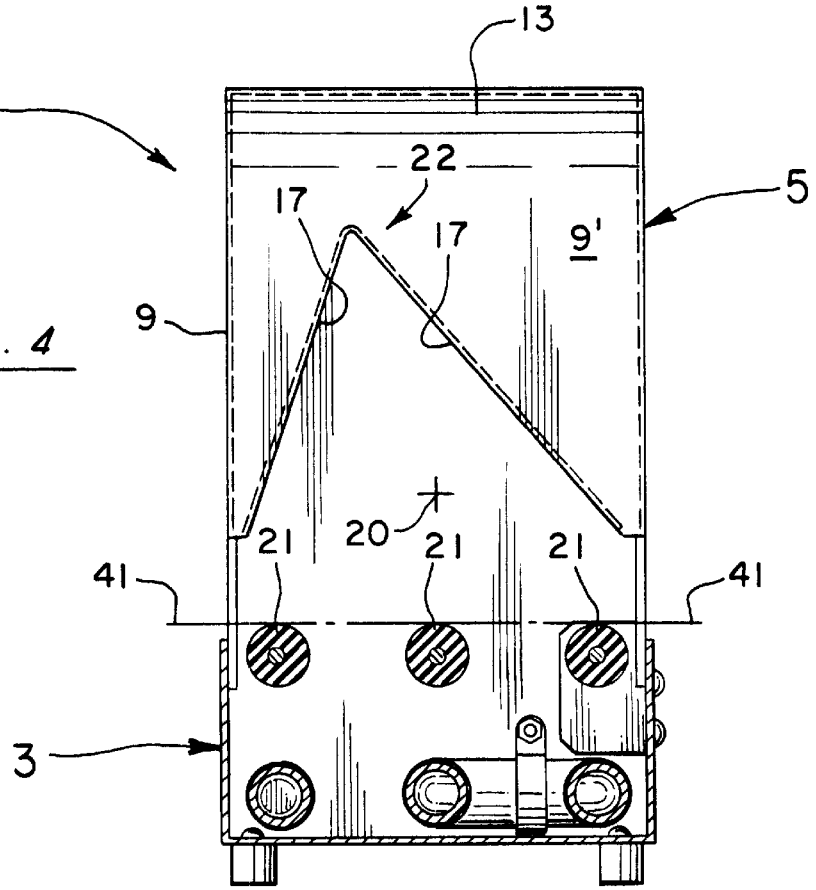
FIG. 4 is a view of a side portion taken alone line 4—4 of FIG. 3.

Each of the spaced-apart side portions 5 of FIG. 2 includes wall sections 9 and 9' extending upwardly from adjacent the base portion 3 and extending substantially about respective vertical axes 11 (see also FIG. 3). Each side portion 5 further includes a top section 13 closing or capping the wall sections 9 and 9' to form a closed, upper end. In this manner, the wall sections 9 and 9' and top section 13 of each side portion 5 form a cavity (see FIGS. 4 and 5) in each of the hollow side portions 5. In the preferred embodiment, the wall sections 9' facing toward the central plane 7 and toward each other have corresponding edge portions 17 and 19 (see FIGS. 1–6 and in particular opening 17 in FIG. 4). The edge portions 17 and 19 of the respective side portions 5 preferably extend at least partially about a axis 20 which is preferably substantially perpendicular to the central, vertical plane 7 (see FIGS. 3, 4, and 6). The openings in the side portions 5 as defined by the respective edge portions 17 and 19 face toward the central plane 7 and toward each other. The hollow side portions 5 in turn open up toward the central plane 7 and toward each other. The opening into each side portion 5 as shown is preferably in the facing wall sections 9' but each opening could be enlarged to include and essentially eliminate the entire wall section 9' if desired. However, the wall sections 9' are preferably present and each of the edge portions 17 and 19 forms an inverted V-shaped opening in the respective wall section 9' of each side portion 5. Further, the upper or apex sections 22 of the inverted V's are preferably off set or spaced from each other along a horizontal axis 7' in the plane 7 (see FIG. 6).

The housing of the device 1 further includes a shoe supporting member or arrangement of three, cylindrical rollers 21 (see FIGS. 1–3). The shoe supporting member of rollers 21 extends substantially horizontally between the side portions 5 adjacent the base portion 3. The rollers 21 are preferably mounted for rotation about axes substantially perpendicular to the central plane 7. Mounted in the base portion 3 are upwardly directed pairs of nozzles 23, 25 and 27, 29 (see FIG. 3). The nozzle pairs 23, 25 and 27, 29 could each be a single nozzle or any multiple of nozzles but in the preferred embodiment, the nozzles 23, 25, 27, and 29 are in pairs as shown. Further, each pair of nozzles 23, 25 and 27, 29 in the preferred embodiment as best seen in FIG. 3 is positioned in one of the gaps or spaces 31 between the rollers 21 of the shoe supporting member. The shoe supporting member 21 in this regard is thus a porous member and the nozzle pairs 23, 25 and 27, 29 are each positioned in a gap 31 of the porous member 21. The upwardly directed sprays from the nozzle pairs 23, 25 and 27, 29 are then preferably directed to pass upwardly through the porous, shoe supporting member 21 in an unobstructed manner.

Figure 5:
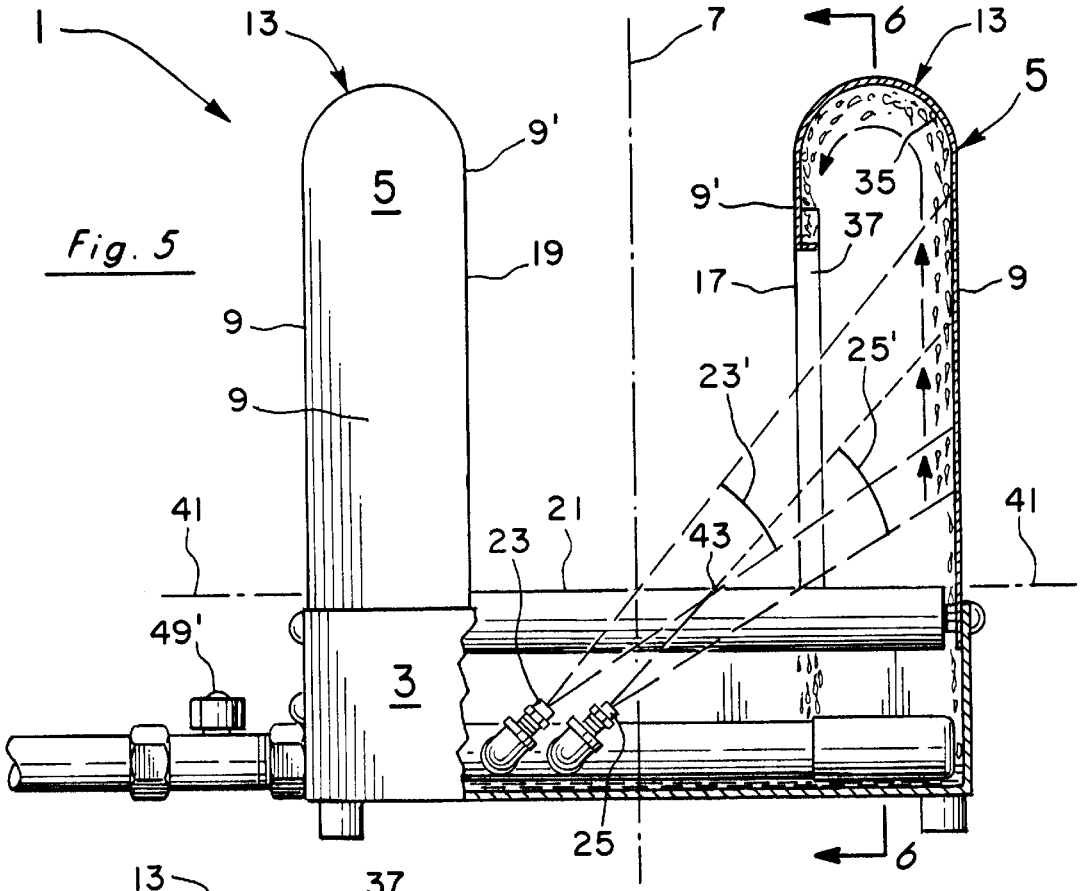
FIG. 5 is a view similar to FIG. 2 but with one side portion cut away to show how it captures the sprays from the opposing nozzles.

More specifically, each pair of nozzles 23, 25 and 27, 29 not only is positioned in a respective gap 31 between adjacent rollers 21 (see FIG. 3) but also is positioned in the base portion 3 on opposite sides of the central plane 7 from each other (see also FIG. 3). Additionally, the sprays from each pair of nozzles 23, 25 and 27, 29 are directed upwardly toward and into the openings 17 and 19 in the respective side portions 5 on the opposite side of the central plane 7. For example, in the preferred embodiment, the sprays from the left pair of nozzles 23 and 25 in FIG. 3 are directed upwardly through the porous, shoe supporting member 21 (see sprays 23' and 25' in FIG. 5) and toward the opening 17 in the right side portion 5 on the opposite side of the central plane 7. The sprays 23' and 25' in this embodiment preferably pass entirely within the vertically extending opening 17 of the right side portion 5 and into the cavity of the right side portion 5. The liquid sprays 23' and 25' then hit the far wall section 9 as shown in FIG. 5 where the upwardly directed sprays 23' and 25' are primarily deflected upwardly by the far wall section 9, about the downwardly curved, inner surface 35 of the top section 13, and back down toward the edge portion 17 that defines the opening into the right side portion 5. The downwardly deflected liquid then strikes the inwardly extending flange portion 37 of the edge portion 17 (see FIGS. 5 and 6) and is channeled and guided downwardly about the opening defined by the edge portion 17 (see FIG. 6) into the base portion 3. In this manner, the liquid (e.g., water) from the spray nozzles 23 and 25 is captured by the right side portion 5 and directed into the base portion 3 which preferably acts as a container to collect the liquid. The collected liquid can then be directed as desired out of the base portion 3, as for example, through the drain hole 39 (see FIGS. 1 and 2).

Figure 6:
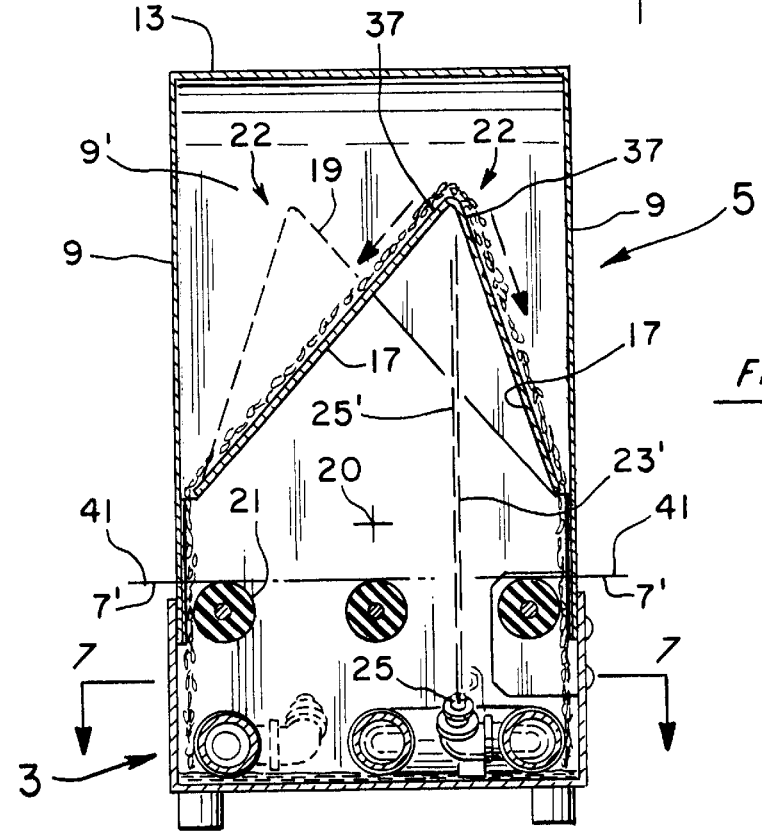
FIG. 6 is a view taken along line 6—6 of FIG. 5.
Figure 7:
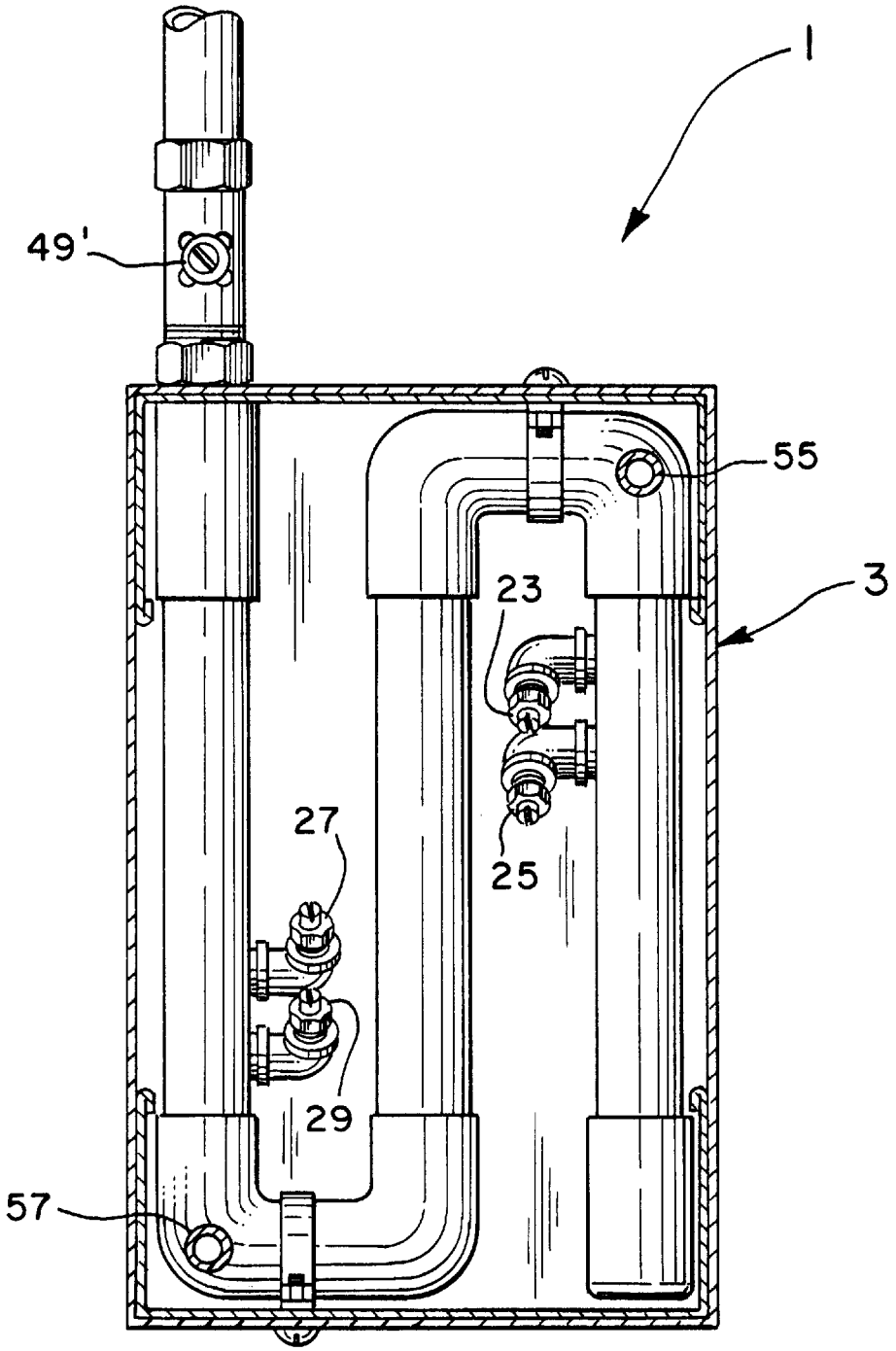
FIG. 7 is a view of the base portion and water feed system taken along line 7—7 of FIG. 6.

The sprays 23' and 25' from the pair of nozzles 23, 25 in FIGS. 5 and 6 are preferably planar or fan sprays and are substantially parallel and spaced from each other so as not to strike one another (see FIG. 6). With a pair of nozzles like 23 and 25, this can be accomplished by spacing the nozzles 23 and 25 laterally relative to each other. Alternatively, and in the preferred embodiment of FIGS. 5 and 6, the nozzles 23 and 25 are inline (see FIG. 7) and using a known technique, the fan nozzles 23 and 25 are axially turned slightly (e.g., 5 degrees) to space the planar sprays 23' and 25' in FIGS. 5 and 6 from each other. In this manner, the sprays 23' and 25' do not strike or otherwise interfere with each other yet each of the sprays 23' and 25' can be directed to pass through the opening 17 substantially adjacent the upper or apex section 22 of the inverted V-shape of the opening 17 (see FIG. 6).

In further reference to the left pair of nozzles 23 and 25 in FIG. 5, the liquid sprays 23' and 25' from the nozzles 23 and 25 are preferably dimensioned and directed so a portion of the outer boundaries of the spray pattern 23' passes through the intersection of the central plane 7 and a horizontal plane 41. The horizontal plane 41 in this regard is simply a reference plane through the top or tangent portions of the rollers 21 of the shoe supporting member (see FIG. 6). Another portion of the boundaries of the spray 23' passes through the horizontal plane 41 substantially at a location 43 in FIG. 5 midway between the central plane 7 and the right side portion 5. The planar spray 23' thus passes upwardly through the plane 41 of the shoe supporting member 21 from the central plane 7 to about halfway to the right side portion 5 along plane 41. In a like manner, the spray 25' from the second nozzle 25 in this pair passes through the plane 41 from the midway location 43 to the right side portion 5. The opposite pair of nozzles 27 and 29 then operates in a similar manner. The result is a series or progression of spaced and substantially parallel sprays (i.e., four in the preferred embodiment) that are crisscrossed with the sprays from the nozzles (e.g., 23 and 25) on one side of the central plane 7 (i.e., the left side in FIG. 5) passing upwardly through the horizontal plane 41 on the opposite (or right) side of the central plane 7 in FIG. 5.

Figure 8:
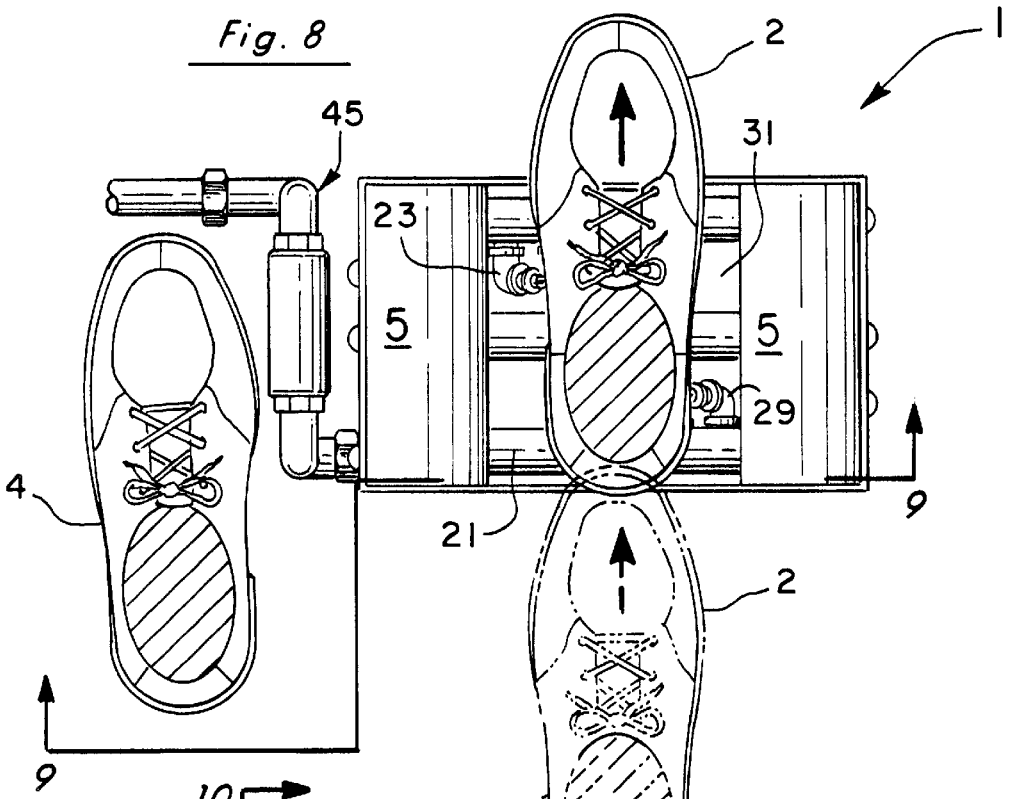
FIG. 8 is a top plan view of the device in use cleaning a shoe.
Figure 9:
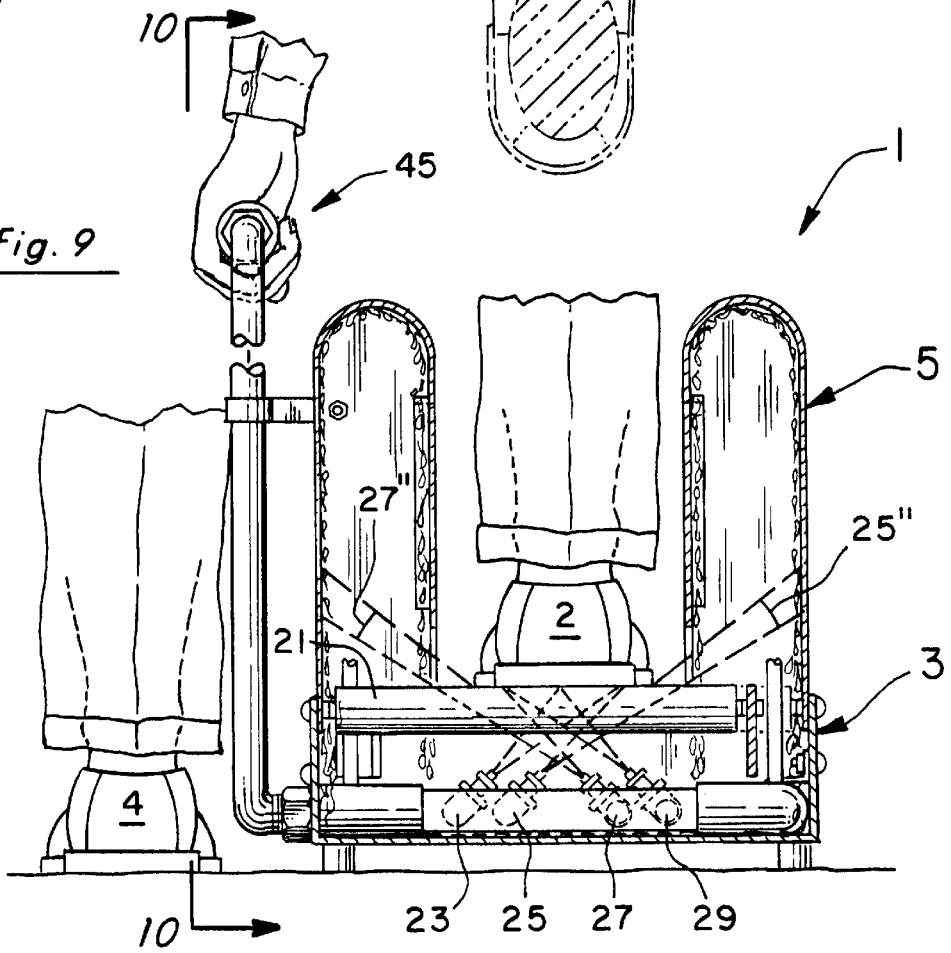
FIG. 9 is a view taken along line 9—9 of FIG. 8.

In operation as shown in FIGS. 8 and 9, the user of the cleaning device 1 of the present invention can place his shoe 2 on the rollers 21 and move the shoe 2 through the housing of the device 1 (FIG. 8). The upwardly directed sprays from the nozzles 23, 25, 27, and 29 then strike and clean the shoe bottom (FIG. 9). As mentioned above and since the sprays are preferably spaced and parallel to each other, the actual cleaning action is really a progression or sequence. More specifically and in one intended mode of operation, the user would place the toe of his shoe 2 on the first roller 21 (see the dotted position of FIG. 8). The user would thereafter move or slide his shoe 2 over the porous, shoe supporting member formed by rollers 21 toward the position shown in solid lines. As the user did so, the sprays from the right or near pair of nozzles 27, 29 would initially strike and clean the left side of the bottom of the user's shoe 2 (see nozzles 27, 29 in FIG. 9). Any spray from the nozzles 27, 29 not striking the shoe bottom (e.g., the spray portion 27" in FIG. 9) would pass by the shoe 2 and be captured in the opposite or left side portion 5 in FIG. 9. The spray portions from nozzles 27 and 29 directly striking the shoe bottom would be deflected downwardly and collected in the base portion 3. Until the advancing shoe bottom in FIG. 8 encountered the sprays from the left or far pair of nozzles 23, 25, the sprays from nozzles 23 and 25 would pass upwardly directly through the gap 31 into the opposite or right side portion 5 in the manner illustrated in FIG. 5.

Once the shoe 2 is moved to the position shown in solid lines in FIGS. 8 and 9, the sprays from both pairs of nozzles 23, 25 and 27, 29 would be striking and cleaning the shoe bottom. That is, the sprays from the near or right pair of nozzles 27, 29 would be cleaning the left half of the heel portion of the shoe 2 at the same time the sprays from the far or left pair of nozzles 23, 25 would be cleaning the right half of the toe portion of the shoe 2. Referring again to FIG. 9, spray portions from the nozzles 23, 25, 27, and 29 striking the shoe bottom would be deflected downwardly into the base portion 3 and spray portions (e.g., 25" and 27") passing by the shoe bottom would be captured in the opposite side portions 5. The user would then complete the cleaning operation by advancing the shoe 2 forward so the remainder of the heel portion (i.e., the right side of the heel in FIG. 8) is cleaned by the sprays from the far or left pair of nozzles 23, 25. In the preferred mode of operation, the user would thereafter draw his shoe 2 back through the device 1. In either mode, the sliding of the shoe bottom over the last roller 21 tends to have a squeegee-like effect to help wipe excess water off the shoe bottom.

Figure 10:
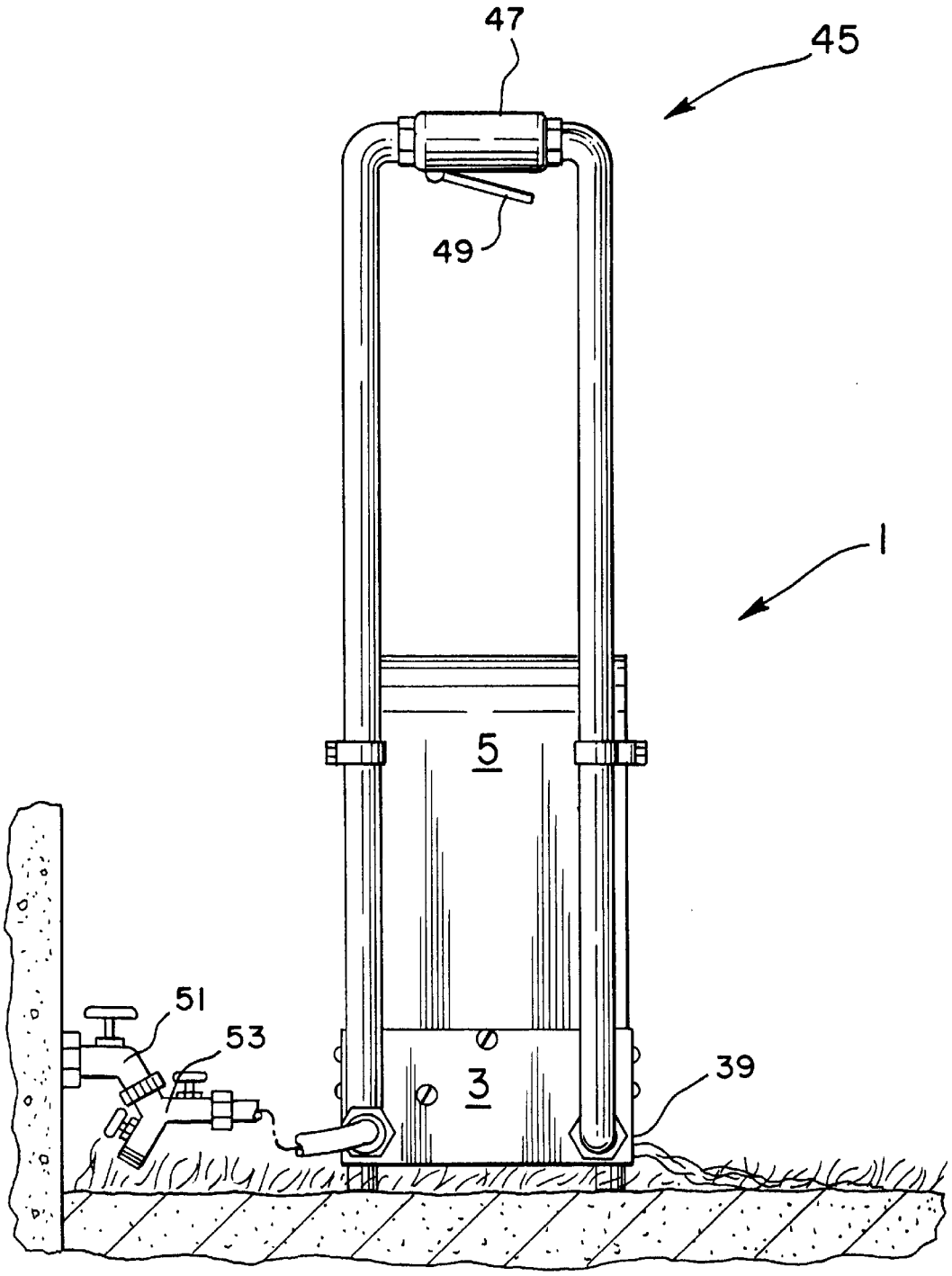
FIG. 10 is a side view taken along line 10—10 of FIG. 9 showing an optional, upstanding handle.

To aid the user in keeping his or her balance, the sizing of the cleaning device 1 enables the user to place his or her other foot (i.e., left foot 4 in FIGS. 8 and 9) directly to the side of the device 1. In this position, the left foot 4 and left leg are shielded and remain dry as the left side portion 5 of the cleaning device 1 blocks and captures any liquid directed to the left. To further aid the user to keep his or her balance, an upstanding handle 45 can be provided and gripped by the user's hand (see FIGS. 8–10). In the preferred embodiment, the control valve 47 in FIG. 10 for the flow of liquid (e.g., water) to the device 1 is also positioned on the handle 45 for easy manipulation of the spring-biased, operating (on/off) lever 49. In this preferred embodiment as shown in FIG. 10, the cleaning device 1 can be simply connected to an outside faucet 51 at a Y-connection 53 to be always charged. The flow through the device 1 can then be controlled by manipulation of the valve lever 49 on the handle 45 with the device 1 at a remote location (e.g., on the user's lawn) spaced from the faucet 51. The captured liquid collected in the base portion 3 in such a case as shown in FIG. 10 could be drained directly into the user's lawn for conservation. Alternatively, a rotatable control valve 49' as shown in the embodiment of FIGS. 1–7 or a foot operated control valve similar to 47 could simply be provided in the hose feeding water to the device 1.

Figure 11:
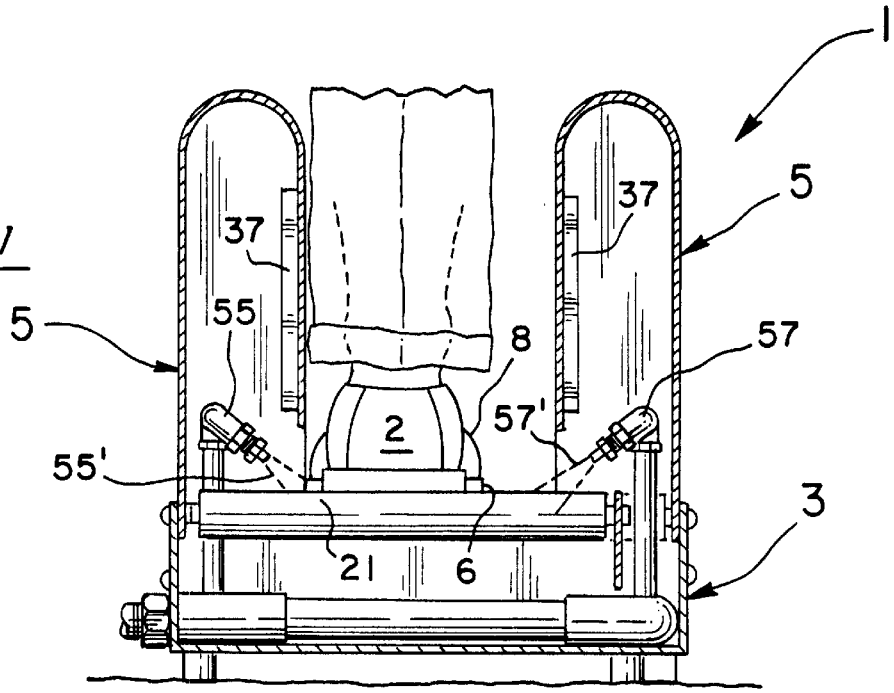
FIG. 11 is a view similar to FIG. 9 showing the operation of the downwardly directed side nozzles.
Figure 12:
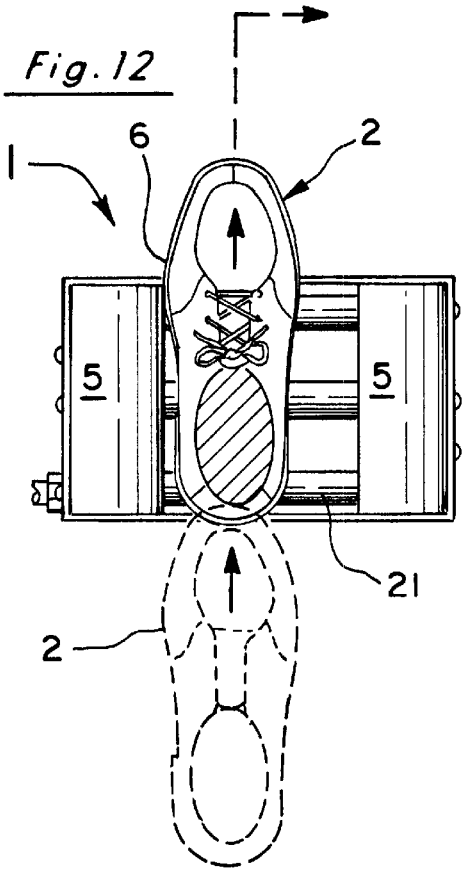
FIG. 12 is a top plan view showing the cleaning device in use.
Figure 13:
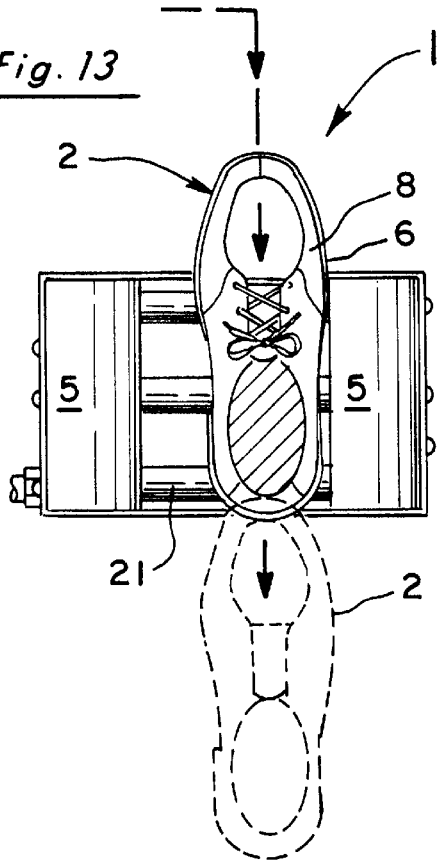
FIG. 13 is a top plan view which shows with FIG. 12 the preferred manner in which the shoe is moved through the device.

FIGS. 11–13 illustrate an additional feature of the invention in which side nozzles 55 and 57 are provided to clean the vertical sides 6 of the shoe 2. In operation, the sprays 55' and 57' from the nozzles 55 and 57 are preferably dimensioned and directed to strike the entire vertical height of the shoe side 6 when the shoe 2 is respectively moved to the left or right in the device 1 to abut a side portion 5 (e.g., the left side portion 5 in FIG. 11). The spray 55' in FIG. 11 then cleans the entire height of the left side 6 of the shoe 2 but does not wet or spray the top portion 8 of the shoe 2. The opposite spray 57' at this point sprays well below the height of the opposite or right shoe side 6 in FIG. 11.

In the preferred mode of operation of FIGS. 11–13, the user would move his or her shoe 2 through the device 1 along a U-shaped path as in FIGS. 12 and 13 to first clean one (i.e., the left) shoe side 6 and then the other. The lower nozzles 23, 25, 27, and 29 are not shown in use in FIGS. 11–13 for clarity but would be present. The device 1 is also preferably dimensioned so part of the shoe bottom is always over the center line or central plane 7 of the device 1. For example, the width of the opening between the side portions 5 could be 6 inches to accommodate typical shoe widths of 4–5 inches. The bottom and sides 6 of the shoe 2 would then all be cleaned using the path of FIGS. 12 and 13. Preferably, the side portions 5 are spaced apart wider than the widest shoe so the shoe can also be moved laterally to clean any spray shadows in the grips of the shoe bottom. Such shadows would be areas of the upwardly indented grips or grooves in the shoe bottom not hit by an inclined spray without moving the shoe sideways. If desired, additional nozzles could be provided to spray the top 8 of the shoe 2 but preferably, the top 8 is not sprayed. As a practical matter, the sprays 55' and 57' would be set to spray no higher (e.g., ½ inch) than the anticipated, shortest height of any shoe side to be cleaned. In the illustrated embodiment of FIGS. 11–13, the shortest height of shoe 2 is in the toe section. Alternatively, the sprays 55' and 57' could be turned off when a shoe with very short sides was being cleaned so as not to wet the top of the shoe. If keeping the top of the shoe as dry as possible is not a primary concern, the sprays from nozzles 55 and 57 could be widened and additional, downwardly directed nozzles could be provided to positively spray and clean the top of the shoe.

In choosing the nozzles for the shoe cleaning device 1 and in particular, the nozzles 23, 25, 27, and 29, great care was taken to adapt the device 1 for efficient cleaning under pressures (e.g., 40 psi) commonly available around the home. 40 psi is also a commonly available pressure from recreational vehicles but only at a pump volume of about 2–3 gallons a minute. Care was also taken to use as little water as possible for conservation considerations and for use with recreational vehicles yet still provide an adequate cleaning effect. For example, in the preferred embodiment, "1505" nozzles were used for nozzles 23, 25, 27, and 29. Such "1505" nozzles have a planar fan spray of 15 degrees and use 0.5 gallons per minute from a water source under 40 pounds per square inch. "2503" nozzles (i.e., 25 degrees planar fan spray using 0.3 gallons per minute at 40 psi) were used for side nozzles 55 and 57. For the most part, the side nozzles 55 and 57 are removing dirt that is less compacted than on the bottom of the shoe so their sprays can be less forceful. Even allowing about 30 seconds to pass each shoe through the device 1, the total water usage is only about 2.6 gallons to clean the bottoms and sides of a pair of shoes. It is anticipated that in most applications, each shoe would take only about 5 seconds to clean and the device 1 would thus use less than a gallon of water to clean a pair of shoes. Although primarily intended to clean shoes, the water sprays are sufficiently gentle that the device 1 can be used for cleaning hands and even pets.

In the preferred mode, the used or captured water is drained onto the lawn. However, if further water conservation is a premium consideration, the device 1 of the present invention could easily be adapted to recycle the captured water (e.g., have its own recirculating pump). It is also noted that if available supply pressures and/or conservation is not a premium consideration, each pair of nozzles 23, 25 and 27, 29 could be replaced by a single nozzle (e.g., spraying about 30 degrees each in the above example). Additional nozzles could also be added and/or aligned along a single pipe to shoot upwardly through only a single gap in the shoe supporting member. Depending upon the number of nozzles, the nozzle sprays could be other than in fan patterns as in the preferred embodiment. The rotatably mounted rollers 21 could also be replaced by other shoe support arrangements (e.g., screen or just the edges of the base portion) if desired. In any event, at least two rollers 21 or contacts are preferred to support and provide stability to the user's shoe, thus helping to keep the shoe level during the cleaning operation through the device 1. It is further noted that the device 1 as shown uses no electricity and for the most part is self-cleaning as the water essentially circulates through the entire device 1 and out the drain 39. The device 1 is also easily portable and sufficiently small to allow for easy shipping and storage.

While several embodiments of the present invention have been shown and described in detail, it is to be understood that various changes and modifications could be made without departing from the scope of the invention.

I claim:

1. A device primarily intended for cleaning the bottom of a shoe, said device including:

a housing having a base portion and two side portions, said side portions extending upwardly from said base portion and being spaced apart from each other on opposite sides of a central plane, said base portion and said spaced-apart side portions defining a substantially U-shaped opening in said housing, said U-shaped opening formed by said base portion and said side portions having a substantially open end and a substantially open top, said housing further including a porous, shoe supporting member extending substantially horizontally between said side portions adjacent said base portion and means for spraying liquid upwardly through said porous, shoe supporting member toward said side portions wherein the bottom of a shoe on the porous, shoe supporting member will be struck and cleaned by said upwardly spraying liquid, each of said spaced-apart side portions being hollow and having means for capturing the liquid sprayed toward the respective side portion, said capturing means of each side portion including wall sections extending upwardly from adjacent said base portion and substantially about a vertical axis, each side portion further including a top section capping said upwardly extending wall sections to form a substantially closed, upper end, said top section and wall sections defining a cavity in each hollow side portion, each of said side portions further including a vertically extending opening into the cavity of the respective side portion defined by an edge portion extending at least partially about an axis substantially perpendicular to said central plane, each of said openings as formed by said edge portions facing toward said central plane and each other, and said spraying means further including means for directing said liquid through said porous, shoe supporting member and through the respective opening in each side portion into the cavity therein wherein the respective, hollow side portions capture said directed liquid.

2. The device of claim 1 wherein the capturing means in each side portion further includes means for channeling the liquid in each side portion downwardly about the edge portion defining the opening in the respective side portion.

3. The device of claim 2 wherein said channeling means includes a flange portion extending inwardly from the edge portion of each opening into the cavity of the respective side portion forming a guide to direct the captured liquid downwardly about the opening defined by the respective edge portion.

4. The device of claim 1 wherein at least one wall section of each side portion faces toward said central plane and toward the one wall section of the other side portion and wherein the edge portions defining said openings are in the respective one wall sections facing each other.

5. The device of claim 1 wherein the top section of each side portion has a downwardly curved, inner surface to deflect downwardly any captured liquid reaching the curved surface.

6. The device of claim 1 wherein said spraying means in said base portion includes at least one nozzle positioned on each side of said central plane, the liquid spray from each nozzle being respectively directed upwardly through said porous, shoe supporting member and through the opening in the side portion on the opposite side of said central plane.

7. The device of claim 6 wherein each of said nozzles sprays the liquid substantially in a plane substantially perpendicular to said central plane.

8. The device of claim 6 wherein each of said nozzles sprays the liquid substantially in a plane and wherein the planes of said nozzle sprays are spaced from each other.

9. The device of claim 6 wherein each of said nozzles sprays the liquid substantially in a plane and wherein the planes of said nozzle sprays are substantially parallel to each other.

10. The device of claim 1 wherein said spraying means in said base portion includes at least one nozzle positioned on each side of said central plane and wherein the liquid spray from each nozzle has a pattern with boundaries and the boundaries of each spray are respectively directed to pass within the opening in the side portion on the opposite side of said central plane.

11. The device of claim 10 wherein the shoe supporting member has upper portions extending substantially in a horizontal plane substantially perpendicular to said central plane and at least a portion of the boundaries of each spray passes substantially through the intersection of said horizontal plane and the central plane.

12. The device of claim 11 wherein said spraying means includes at least a second nozzle on each side of said central plane with the boundaries of the spray from each second nozzle being respectively directed to pass within the opening in the side portion on the opposite side of the central plane.

13. The device of claim 12 wherein the horizontal plane extends at least between the side portions and wherein portions of the boundaries of the spray from each one nozzle on each side of the central plane respectively pass substantially through the intersection of said horizontal plane and the central plane and through the horizontal plane substantially at a location midway between the central plane and the respective, opposite side portion and wherein portions of the boundaries of the spray from each of the second nozzles on each side of the central plane substantially pass through said horizontal plane at said location midway between the central plane and the respective opposite side portions and through the horizontal plane substantially at the opposite side portion.

14. The device of claim 1 wherein each opening defined by the respective edge portions in said side portions is substantially an inverted V-shape.

15. The device of claim 1 wherein the openings defined by the respective edge portions in said side portions have substantially similar shapes.

16. The device of claim 1 wherein the openings defined by the respective edge portions in said side portions have sections spaced from each other along a horizontal axis extending in said central plane.

17. The device of claim 1 wherein each opening defined by the respective edge portions in each side portion has an apex and said spraying means in said base portion includes at least one nozzle positioned on each side of said central plane, the liquid spray from each nozzle being respectively directed upwardly substantially in a plane substantially adjacent the apex of the opening of the side portion on the opposite side of the central plane.

18. The device of claim 1 wherein said porous, shoe supporting member includes at least one roller and means for mounting said roller for rotation about a substantially horizontal axis substantially perpendicular to said central axis.

19. The device of claim 1 wherein said porous, shoe supporting member has portions spaced from each other to create at least two gaps and said spraying means includes at least one nozzle positioned on each side of said central plane, the liquid sprays from said nozzles being respectively directed upwardly through a different one of said gaps.

20. The device of claim 1 further including means for directing the liquid captured by said side portions into said base portion.

21. The device of claim 20 wherein said base portion is a container to collect the liquid directed therein.

22. The device of claim 1 further including second spray means positioned above said shoe supporting member and having at least one spray nozzle on each side of said central plane respectively directed downwardly toward said central plane and toward said shoe supporting member.

23. The device of claim 1 further including an upstanding handle for gripping by a user of the device to help the user maintain balance.

24. The device of claim 1 further including a valve for controlling flow of liquid to said spraying means and an upstanding handle with means for operating said valve.

25. A method for cleaning the bottom of a shoe using liquid, said method including the steps of:

(a) providing a housing with a base portion and two side portions extending upwardly from said base portion and spaced apart from each other on opposite sides of a central plane to form a substantially U-shaped opening in said housing, the U-shaped opening having a substantially open end and a substantially open top, (b) providing a porous, shoe supporting member extending substantially horizontally between said side portions adjacent said base portion, (c) placing the bottom of the shoe on said porous, shoe supporting member, (d) directing at least one liquid spray from one side of said central plane upwardly through said porous, shoe supporting member toward the bottom of the shoe and toward the side portion on the opposite side of the central plane, (e) directing at least one liquid spray from the other side of said central plane upwardly through said porous, shoe supporting member toward the bottom of the shoe and toward the side portion on the opposite side of the central plane, and (f) capturing in each respective side portion of said housing the liquid directed toward the respective side portion passing by the bottom of said shoe being cleaned.

26. The method of claim 25 further including the limitation of directing the respective liquid sprays of steps (d) and (e) substantially in planes substantially perpendicular to said central plane.

27. The method of claim 25 further including the limitation of directing the respective liquid sprays of steps (d) and (e) substantially in planes spaced from each other.

28. The method of claim 25 further including the limitation of directing the respective liquid sprays of steps (d) and (e) substantially in planes substantially parallel to each other.

29. The method of claim 25 further including the limitation of directing the respective liquid spray of steps (d) and (e) upwardly through said porous, shoe supporting member substantially on the respective opposite side of said central plane.

30. The method of claim 25 wherein said side portions are hollow and said method further includes the limitations of providing an opening into each of said hollow side portions and directing the respective spray of steps (d) and (e) to be received within the opening in the side portion on the respective opposite side of said central plane.

31. The method of claim 25 further including the step of directing the liquid captured in the side portions in step (f) into the base portions.

32. The method of claim 25 including the further limitation of moving the bottom of said shoe over the porous, shoe supporting member in a plane substantially perpendicular to said central plane.

33. The method of claim 32 including the further limitation of moving said shoe over said porous, shoe supporting member to substantially abut each respective side portion.

34. The method of claim 33 wherein said shoe has sides extending vertically a first height and said method further includes the step of directing at least one liquid spray on each side of said central plane downwardly toward said central plane and toward the respective side of said shoe to strike substantially the entire height of each respective shoe side when said shoe is abutting the respective side portion of said housing.

35. The method of claim 25 further including the step of providing an upstanding handle to aid a user to maintain balance.

36. The method of claim 25 further including the limitations of providing a valve for controlling the flow of the liquid sprays of steps (d) and (e) and providing an upstanding handle with a control for said valve.

* * * * *